US006104288A

United States Patent [19]

Hopkins

[11] Patent Number: 6,104,288

[45] Date of Patent: Aug. 15, 2000

[54] DOOR MOUNTED AUDIO REMINDER

[76] Inventor: John L. Hopkins, 2521 Ponderosa Dr., Greensboro, N.C. 27406

[21] Appl. No.: 09/267,022

[22] Filed: Mar. 11, 1999

[51] Int. Cl.[7] ..... G08B 13/08

[52] U.S. Cl. ..... 340/545.1; 340/547; 340/692

[58] Field of Search ..... 340/545.1, 546, 340/547, 545.6, 545.7, 545.8, 545.9, 692; 200/61.62

[56] References Cited

U.S. PATENT DOCUMENTS

| | | | |
|---|---|---|---|
| D. 260,741 | 9/1981 | Lam | D10/104 |
| 3,266,029 | 8/1966 | Callahan | 340/545.1 |
| 3,465,325 | 9/1969 | Goldfarb et al. | 340/545.1 |
| 3,938,120 | 2/1976 | O'Connell | 340/545.1 |
| 4,100,581 | 7/1978 | Slack et al. | 340/692 |
| 4,258,358 | 3/1981 | Lee et al. | 340/543 |
| 4,359,646 | 11/1982 | Mejia et al. | 340/693 |
| 4,835,520 | 5/1989 | Aiello | 340/545.1 |
| 5,266,920 | 11/1993 | Langner | 340/571 |
| 5,602,526 | 2/1997 | Read | 340/457 |
| 5,668,533 | 9/1997 | Jackson et al. | 340/547 |
| 5,721,532 | 2/1998 | Lehmann et al. | 340/571 |
| 5,856,781 | 1/1999 | Michel et al. | 340/547 |
| 5,894,275 | 4/1999 | Swingle | 340/692 |

*Primary Examiner*—Nina Tong

[57] ABSTRACT

An audio system is provided for reminding a person exiting a building to possess a key. Included is a speaker for emitting audible audio signals. Also provided is a detection mechanism for indicating that a door of a doorway has been opened. Control circuitry is connected between the speaker and the detection mechanism. The control circuitry is adapted to emit audio signals via the speaker reminding a person exiting a building to possess a key only upon the detection mechanism indicating that the door of the doorway has been opened.

4 Claims, 2 Drawing Sheets

10
12

14
16
14
24

18
26
28
22
20

DOOR MOUNTED AUDIO REMINDER

BACKGROUND OF THE INVENTION

1. Field of the Invention

The present invention relates to door alerts and more particularly pertains to a new door mounted audio reminder for reminding a person exiting a building to possess a key.

2. Description of the Prior Art

The use of door alerts is known in the prior art. More specifically, door alerts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U. S. Pat. No. 4,100,581; U.S. Pat. No. 3,938,120; U.S. Pat. No. 3,266,029; U.S. Pat. No. 4,835,520; U.S. Pat. No. 3,465,325; and U.S. Pat. Des. No. 260,741.

In these respects, the door mounted audio reminder according to the present invention substantially departs from the conventional concepts and designs of the prior art, and in so doing provides an apparatus primarily developed for the purpose of reminding a person exiting a building to possess a key.

SUMMARY OF THE INVENTION

In view of the foregoing disadvantages inherent in the known types of door alerts now present in the prior art, the present invention provides a new door mounted audio reminder construction wherein the same can be utilized for reminding a person exiting a building to possess a key.

The general purpose of the present invention, which will be described subsequently in greater detail, is to provide a new door mounted audio reminder apparatus and method which has many of the advantages of the door alerts mentioned heretofore and many novel features that result in a new door mounted audio reminder which is not anticipated, rendered obvious, suggested, or even implied by any of the prior art door alerts, either alone or in any combination thereof.

To attain this, the present invention is adapted for use with a doorway of a building having an opening with a doorjamb. A door is hingably coupled within the opening and includes a door knob for facilitating the opening of the door. Next provided is a magnet assembly including a mounting plate with a substantially planar square configuration. Bores are formed in each corner of the mounting plate for allowing the mounting plate to be mounted to an interior surface of the doorjamb of the doorway via screws. The magnet assembly further has a plurality of magnet pieces coupled along a side edge of the mounting plate in a uniformly spaced manner. For reasons that will soon become apparent, an interior edge of each of the magnet pieces is positioned coextensive with the periphery of the opening of the doorway. As shown in FIGS. 2 & 3, an audio assembly is provided including a housing mounted on an interior surface of the door of the doorway. Ideally, such housing is positioned above the door knob and level with the magnet assembly. A light is mounted on the housing for illuminating upon the actuation thereof. Associated therewith is a speaker mounted on the housing for emitting audible audio signals. Mounted on a side face of the housing is a detection mechanism that is positioned coextensive with the periphery of the opening of the doorway adjacent to the magnet pieces of the magnet assembly.

Control circuitry is connected between a battery, the light, the speaker and the detection mechanism. In use, the control circuitry serves to emit audio signals via the speaker that remind a person exiting a building to possess a key. This is only effected upon the detection mechanism indicating that the door of the doorway has been opened. In addition, the control circuitry is further adapted to actuate the light upon a power level of the battery falling below a predetermined amount.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new door mounted audio reminder apparatus and method which has many of the advantages of the door alerts mentioned heretofore and many novel features that result in a new door mounted audio reminder which is not anticipated, rendered obvious, suggested, or even implied by any of the prior art door alerts, either alone or in any combination thereof.

It is another object of the present invention to provide a new door mounted audio reminder which may be easily and efficiently manufactured and marketed.

It is a further object of the present invention to provide a new door mounted audio reminder which is of a durable and reliable construction.

An even further object of the present invention is to provide a new door mounted audio reminder which is susceptible of a low cost of manufacture with regard to both materials and labor, and which accordingly is then susceptible of low prices of sale to the consuming public, thereby making such door mounted audio reminder economically available to the buying public.

Still yet another object of the present invention is to provide a new door mounted audio reminder which provides in the apparatuses and methods of the prior art some of the advantages thereof, while simultaneously overcoming some of the disadvantages normally associated therewith.

Still another object of the present invention is to provide a new door mounted audio reminder for reminding a person exiting a building to possess a key.

Even still another object of the present invention is to provide a new door mounted audio reminder that includes a speaker for emitting audible audio signals. Also provided is a detection mechanism for indicating that a door of a doorway has been opened. Control circuitry is connected between the speaker and the detection mechanism. The control circuitry is adapted to emit audio signals via the speaker reminding a person exiting a building to possess a key only upon the detection mechanism indicating that the door of the doorway has been opened.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
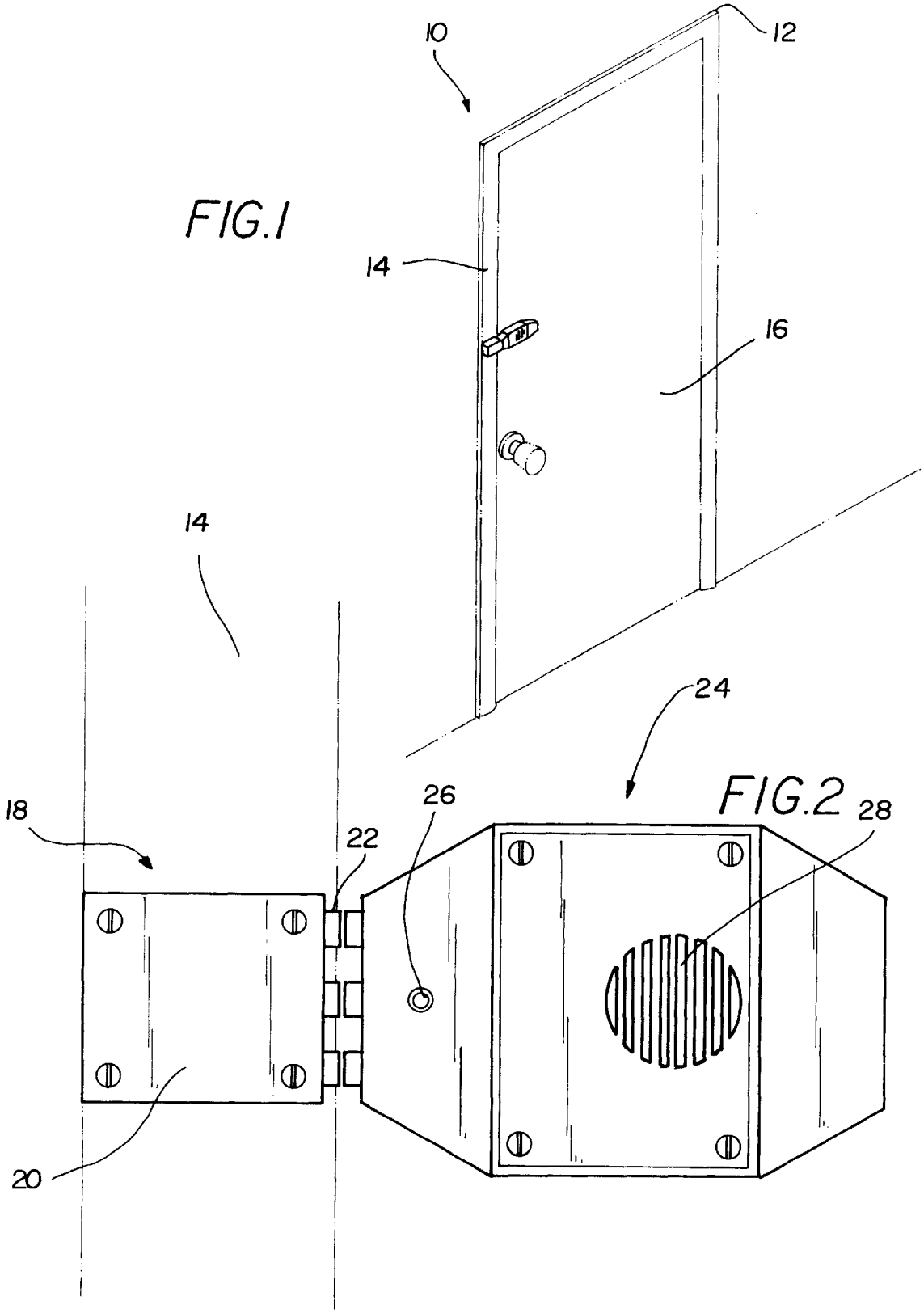
FIG. 1 is a perspective view of a new door mounted audio reminder according to the present invention.
FIG. 2 is a front view of the present invention.

With reference now to the drawings, and in particular to FIGS. 1 through 4 thereof, a new door mounted audio reminder embodying the principles and concepts of the present invention and generally designated by the reference numeral 10 will be described.

The present invention, designated as numeral 10, is adapted for use with a doorway 12 of a building having an opening with a doorjamb 14. A door 16 is hingably coupled within the opening and includes a door knob for facilitating the opening of the door.

The present invention includes a magnet assembly 18 having a mounting plate 20 with a substantially planar square configuration. Bores are formed in each corner of the mounting plate for allowing the mounting plate to be mounted to an interior surface of the doorjamb of the doorway via screws. The magnet assembly further has a plurality of magnet pieces 22 coupled along a side edge of the mounting plate in a uniformly spaced manner. For reasons that will soon become apparent, an interior edge of each of the magnet pieces is positioned coextensive with the periphery of the opening of the doorway.

Figure 3:
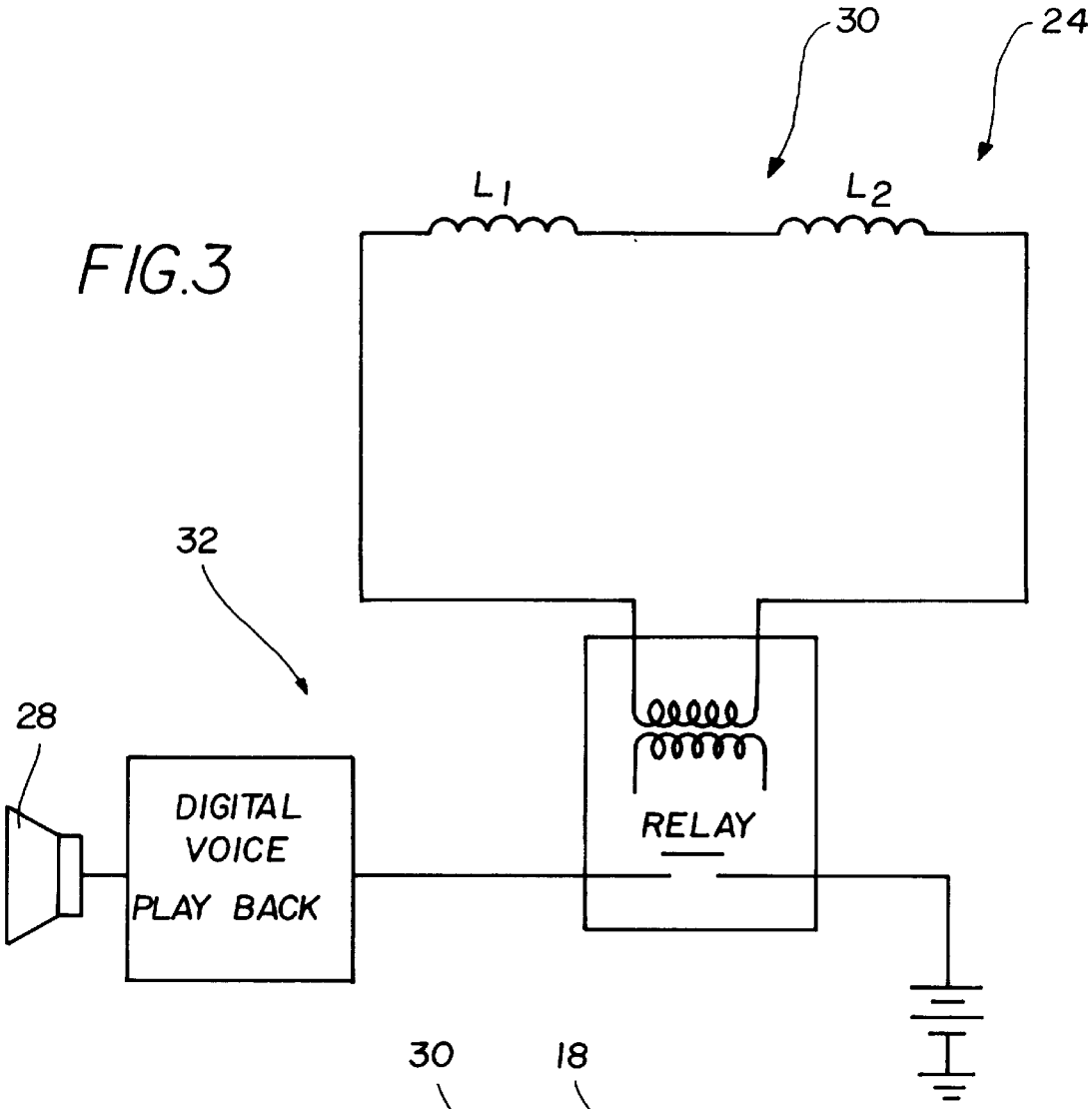
FIG. 3 is a schematic diagram of the audio assembly of the present invention.
Figure 4:
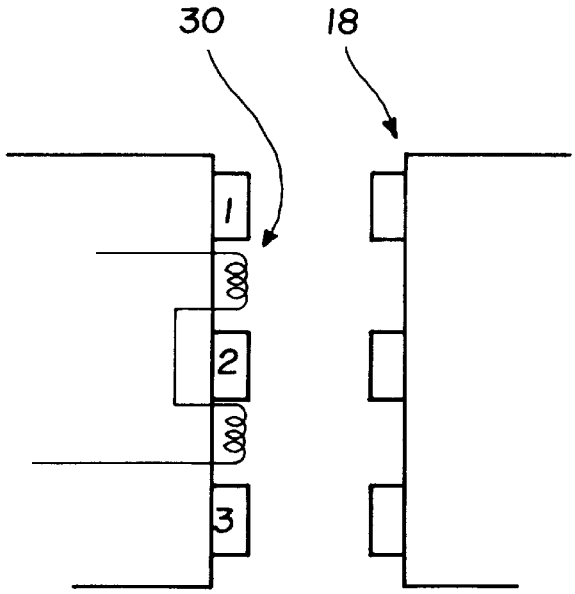
FIG. 4 is a schematic diagram of the magnet assembly and detection mechanism of the present invention.

As shown in FIGS. 2 & 3, an audio assembly 24 is provided including a housing mounted on an interior surface of the door of the doorway. Ideally, such housing is positioned above the door knob and level with the magnet assembly. A light 26 is mounted on the housing for illuminating upon the actuation thereof. Associated therewith is a speaker 28 mounted on the housing for emitting audible audio signals. Mounted on a side face of the housing is a detection mechanism 30 that is positioned coextensive with the periphery of the opening of the doorway adjacent to the magnet pieces of the magnet assembly. As an option, the detection mechanism may include a plurality of inductors positioned adjacent to the magnets such that a current is induced upon the movement of the inductors with respect to the magnets, as is the case when the door is opened. Connected to the inductors is a relay coil with an associated contact which closes upon the receipt of the current by the relay coil. It should be noted that any other type of detection mechanism such as a reed switch or the like may be employed for accomplishing a similar objective.

Control circuitry 32 in the form of a digital voice play back mechanism is connected between a battery, the light, the speaker and the detection mechanism. In use, the control circuitry serves to emit audio signals via the speaker that remind a person exiting a building to possess a key. This is only effected upon the detection mechanism indicating that the door of the doorway has been opened and the relay contact is closed. In addition, the control circuitry is further adapted to actuate the light upon a power level of the battery falling below a predetermined amount.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An audio system for reminding a person exiting a building to possess a key comprising, in combination:

a doorway of a building having an opening with a doorjamb and a door hingably coupled within the opening and including a door knob for facilitating the opening of the door;

a magnet assembly including a mounting plate with a substantially planar square configuration and bores formed in each corner thereof for being mounted to an interior surface of the doorjamb of the doorway via screws, the magnet assembly further including a plurality of magnet pieces coupled along a side edge of the mounting plate in a uniformly spaced manner, wherein an interior edge of each of the magnet pieces is positioned coextensive with the periphery of the opening of the doorway; and an audio assembly including a housing mounted on an interior surface of the door of the doorway above the door knob and level with the magnet assembly, a light mounted on the housing for illuminating upon the actuation thereof, a speaker mounted on the housing for emitting audible audio signals, a detection mechanism mounted on a side face of the housing and positioned coextensive with the periphery of the opening of the doorway adjacent to the magnet pieces of the magnet assembly, and control circuitry connected between a battery, the light, the speaker and the detection mechanism, the control circuitry adapted to emit audio signals via the speaker reminding a person exiting a building to possess a key only upon the detection mechanism indicating that the door of the doorway has been opened, the control circuitry further adapted to actuate the light upon a power level of the battery falling below a predetermined amount.

2. An audible reminder system for reminding a person exiting a building to possess a key, the building having a doorway with an opening defined by a doorjamb, and a door pivotally coupled to the doorjamb and positionable in the opening, the audible reminder system comprising:

a magnet assembly including a mounting plate for mounting to an interior surface of the doorjamb of the doorway; and an audio assembly including:

a housing mountable on an interior surface of the door of the doorway;

a speaker mounted in the housing for emitting audible sounds;

a detection mechanism mounted on the housing for positioning adjacent to an edge of the door in substantial vertical alignment with the magnet assembly; and control circuitry connected between a battery, the speaker and the detection mechanism;

wherein the detection mechanism is adapted to detect movement of the housing away from the magnet assembly and send a detection signal to the control circuitry; and wherein, upon the receipt of the detection signal from the detection mechanism, the control circuitry is adapted to generate signals for causing the speaker to emit a voice playback of a message reminding a person opening the door to possess a key upon leaving the building;

wherein the magnet assembly includes a plurality of magnets mountable on the doorway for working in conjunction with the detection mechanism to indicate that the door of the doorway has been opened.

3. The audio system as set forth in claim 2 wherein the control circuitry is further adapted to actuate a light upon a power level of a battery connected to the control assembly falling below a predetermined amount.

4. An audible reminder system for reminding a person exiting a building to possess a key, the building having a doorway with an opening defined by a doorjamb, and a door pivotally coupled to the doorjamb and positionable in the opening, the audible reminder system comprising:

a magnet assembly including a mounting plate for mounting to an interior surface of the doorjamb of the doorway, the magnet assembly further including at least one magnet piece mounted along a side edge of the mounting plate, wherein an interior edge of the at least one magnet piece is positioned coextensive with the periphery of the opening of the doorway; and an audio assembly including:

a housing mountable on an interior surface of the door of the doorway,in vertical alignment with the magnet assembly;

a light mounted on the housing for illuminating based upon a power level of the battery, the light being illuminated when the power level falls below a predetermined amount;

a speaker mounted on the housing for emitting audible sounds;

a detection mechanism mounted on a side face of the housing for positioning adjacent to an edge of the door in alignment with the at least one magnet piece of the magnet assembly; and control circuitry connected between a battery, the light, the speaker and the detection mechanism;

wherein the detection mechanism is adapted to detect movement of the housing away from the magnet assembly and send a detection signal to the control circuitry; and wherein, upon the receipt of the detection signal from the detection mechanism, the control circuitry is adapted to generate signals for causing the speaker to emit a voice playback of a message reminding a person opening the door to possess a key upon leaving the building;

wherein a plurality of magnet pieces are included, and wherein the plurality of magnet pieces are arranged in a substantially uniformly spaced manner with respect to each other.

* * * * *